US011670269B2

(12) United States Patent
Sato et al.

(10) Patent No.: US 11,670,269 B2
(45) **Date of Patent: *Jun. 6, 2023**

(54) KEYBOARD INSTRUMENT

(71) Applicant: CASIO COMPUTER CO., LTD., Tokyo (JP)

(72) Inventors: So Sato, Tokyo (JP); Naoya Ishibashi, Tokyo (JP); Kouji Oshima, Tokyo (JP); Naoto Imamura, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 10 days.

This patent is subject to a terminal disclaimer.

(21) Appl. No.: 17/392,524

(22) Filed: Aug. 3, 2021

(65) Prior Publication Data

US 2021/0366451 A1 Nov. 25, 2021

Related U.S. Application Data

(63) Continuation of application No. 16/593,801, filed on Oct. 4, 2019, now Pat. No. 11,107,449.

(30) Foreign Application Priority Data

Oct. 18, 2018 (JP) ..... JP2018-196826

(51) Int. Cl.
*G10H 1/34* (2006.01)
*G10H 1/00* (2006.01)

(52) U.S. Cl.
CPC ..... *G10H 1/346* (2013.01); *G10H 1/0008* (2013.01); *G10H 2220/221* (2013.01)

(58) Field of Classification Search
CPC . G10H 1/346; G10H 1/0008; G10H 2220/221
(Continued)

(56) References Cited

U.S. PATENT DOCUMENTS 5,406,875 A * 4/1995 Tamai ..... G10H 1/344 84/719
7,485,798 B2 * 2/2009 Nishida ..... G10C 3/12 84/18

(Continued)

FOREIGN PATENT DOCUMENTS

JP 2004-226688 A 8/2004
JP 2007-025602 A 2/2007

(Continued)

OTHER PUBLICATIONS

Japanese Office Action dated Aug. 24, 2020, in a counterpart Japanese patent application No. 2018-196826. (A machine translation (not reviewed for accuracy) attached. Cited in the parent U.S. Appl. No. 16/593,801).

*Primary Examiner* — Christina M Schreiber
(74) *Attorney, Agent, or Firm* — Chen Yoshimura LLP

(57) ABSTRACT

An electronic portable keyboard instrument includes: a lower casing that includes a plurality of supporting members that support the fulcrums of a plurality of hammers, and a plurality of reinforcing members arranged in the first direction, each reinforcing member having a shape of rib that is erected upward from the lower casing and that is running in a length direction of the keys, wherein each of the plurality of supporting members sandwiches, from sides in the first direction, the corresponding hammer at the fulcrum so as to restrict movement of the hammer in the first direction, and wherein each of the reinforcing members is disposed in a gap between adjacent hammers, and a portion of the reinforcing members that corresponds to the weights of the adjacent hammers in position is lower than any other portions of the reinforcing member to avoid contacting the weights of the adjacent hammers.

5 Claims, 15 Drawing Sheets

(58) Field of Classification Search
USPC ..... 84/644
See application file for complete search history.

(56) References Cited

U.S. PATENT DOCUMENTS

| | | | | |
|---|---|---|---|---|
| 2004/0261598 | A1* | 12/2004 | Uno | G10H 1/346 84/235 |
| 2005/0011330 | A1* | 1/2005 | Shimoda | G10C 3/12 84/1 |
| 2007/0017341 | A1* | 1/2007 | Nishida | G10C 3/12 84/423 R |
| 2007/0017356 | A1* | 1/2007 | Nishida | G10H 1/346 84/744 |
| 2009/0007757 | A1* | 1/2009 | Nishida | G10H 1/346 84/433 |
| 2010/0071534 | A1* | 3/2010 | Kitajima | G10H 1/346 84/439 |
| 2010/0074668 | A1* | 3/2010 | Suzuki | G10H 1/346 400/495 |
| 2013/0180390 | A1* | 7/2013 | Ishida | G10H 1/34 84/745 |
| 2014/0298976 | A1* | 10/2014 | Kato | G10H 1/32 84/718 |
| 2016/0293152 | A1* | 10/2016 | Takata | G10H 1/346 |
| 2018/0182363 | A1* | 6/2018 | Hoshino | G10H 1/32 |
| 2018/0286367 | A1* | 10/2018 | Tanoue | G10H 1/344 |
| 2018/0286368 | A1* | 10/2018 | Tanoue | G10H 1/344 |
| 2019/0019483 | A1* | 1/2019 | Kuno | G10H 1/346 |
| 2019/0392801 | A1* | 12/2019 | Takahashi | G10H 1/346 |
| 2020/0005749 | A1* | 1/2020 | Ichiki | G10B 3/12 |
| 2020/0043446 | A1* | 2/2020 | Akaishi | G10C 3/23 |
| 2020/0126527 | A1* | 4/2020 | Sato | G10H 1/346 |
| 2021/0366451 | A1* | 11/2021 | Sato | G10H 1/0008 |

FOREIGN PATENT DOCUMENTS

| | | | |
|---|---|---|---|
| JP | 2008-304721 | A | 12/2008 |
| JP | 2011-221560 | A | 11/2011 |
| JP | 2013-210658 | A | 10/2013 |
| JP | 2014-211618 | A | 11/2014 |

* cited by examiner

KEYBOARD INSTRUMENT

TECHNICAL FIELD

The present invention relates to a keyboard instrument including a keyboard device such as an electronic piano, and more specifically, to an electronic portable keyboard instrument, such as electronic portable piano.

BACKGROUND ART

Conventionally, in the field of electronic keyboard instruments such as electronic pianos, various methods of reinforcement have been utilized to improve the strength of the casing of the main instrument unit. For example, Japanese Patent Application Laid-Open Publication No. 2014-211618 discloses a casing structure in which a plurality of hanging portions having the dual function of reinforcing the casing and supporting sound adjusters (sound absorbers) for improving the acoustic properties of an electronic keyboard instrument are arranged along the sidewalls of the casing, and each hanging portion is connected to a sidewall of the casing via a connecting rib.

SUMMARY OF THE INVENTION

The casing structure disclosed in Embodiment 1 of the abovementioned application is effective in terms of improving strength around the periphery of the sidewalls of the casing but exhibits problems such as the following. In other words, by virtue of including a keyboard unit in which a plurality of keys are arranged in a line, the electronic keyboard instrument must have a casing which is elongated in the arrangement direction of the keys. In an electronic keyboard instrument having a casing of this type, designing the wall thickness of casing members to be thin in order to achieve reduced size and weight results in decreased strength in the lengthwise direction of the casing and makes the casing more prone to deformations such as bending and twisting, thereby making the main instrument unit more prone to damage and potentially having a negative impact on the operability or acoustic properties of the musical instrument. Therefore, there is demand for casing structures which solve these types of problems more effectively.

The present invention aims to effectively improve casing strength and to make it possible to reduce size and weight.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic portable keyboard instrument, comprising: a plurality of keys arranged in a first direction; a plurality of hammers each having a force application point, a weight, and a fulcrum between the force application point and the weight; a lower casing that includes a plurality of supporting members that support the respective fulcrums of the plurality of hammers so that each hammer rocks in vertical directions about the fulcrum when a corresponding key is pressed; and a plurality of reinforcing members arranged in the first direction, each of the reinforcing members having a shape of rib that is erected upward from the lower casing and that is running in a length direction of the keys, which is perpendicular to the first direction, wherein each of the plurality of supporting members sandwiches, from sides in the first direction, the corresponding hammer at the fulcrum so as to restrict movement of the hammer in the first direction, and wherein each of the reinforcing members is disposed in a gap between adjacent hammers, and a portion of the reinforcing members that corresponds to the weights of the adjacent hammers in position is lower than any other portions of the reinforcing member so that, if the adjacent hammers move in the first direction about the fulcrums, the weights of the adjacent hammers do not contact the reinforcing member.

In another aspect, the present disclosure provides an electronic portable keyboard instrument, comprising: a plurality of keys arranged in a first direction; a plurality of hammers arranged in the first direction, respectively corresponding to the plurality of keys, each of the plurality of hammers including a force application point that is formed on one end side and that is pressed down when the corresponding key is pressed, a weight that is formed on another end side and imparts action weight to a pressed key, and a fulcrum formed between the force application point and the weight so that the hammer rocks in vertical directions about the fulcrum when the corresponding key is pressed; and a casing including a plurality of reinforcing members arranged in the first direction, each of the reinforcing members being formed in a gap between the plurality of hammers so as not to be contacted by the weights of the hammers adjacent to the reinforcing member when the hammers adjacent to the reinforcing member rock about the respective fulcrums with a lateral positional shift in the first direction, so that even if the keyboard instrument is placed vertically with one lateral end thereof being at a bottom and another lateral end thereof being at a top, the weights of the hammers leaning downward due to gravity do not contact any of the reinforcing members.

It is to be understood that both the foregoing general description and the following detailed description are exemplary and explanatory, and are intended to provide further explanation of the invention as claimed.

DETAILED DESCRIPTION OF EMBODIMENTS

Next, embodiments of the present invention will be described in detail with reference to figures.

(Keyboard Instrument)

Figure 1A:
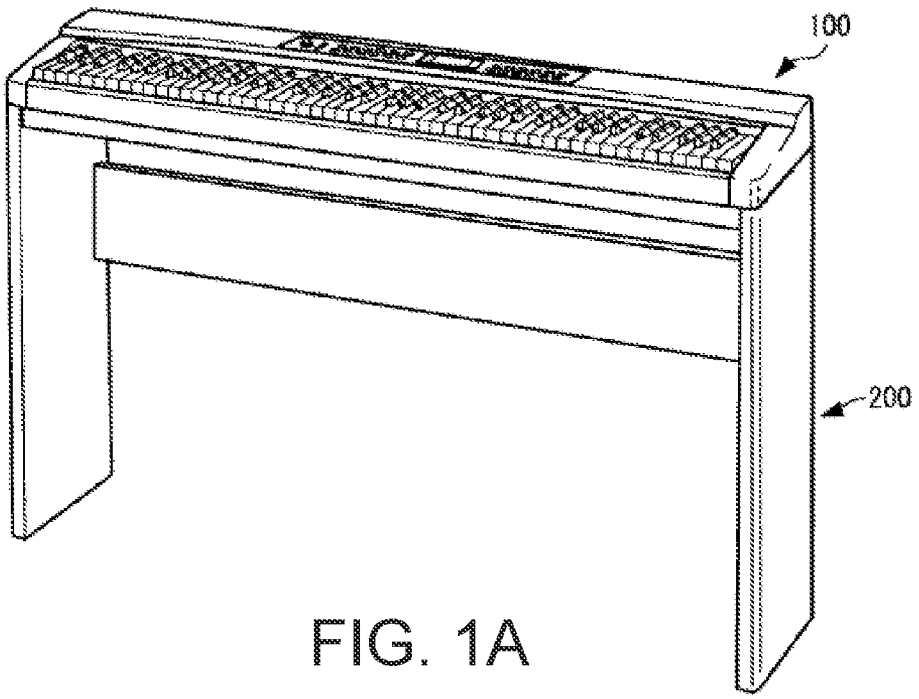
FIGS. 1A and 1B are external views illustrating an embodiment of a keyboard instrument according to the present invention.
Figure 1B:
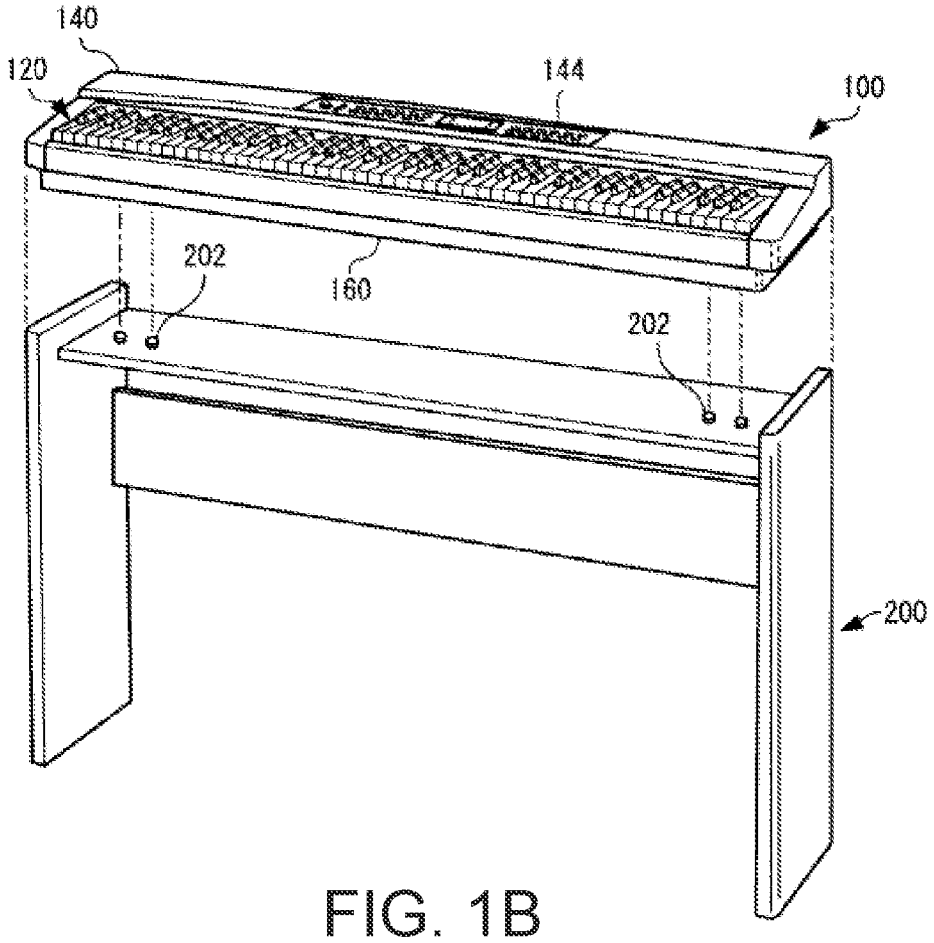
Figure 2:
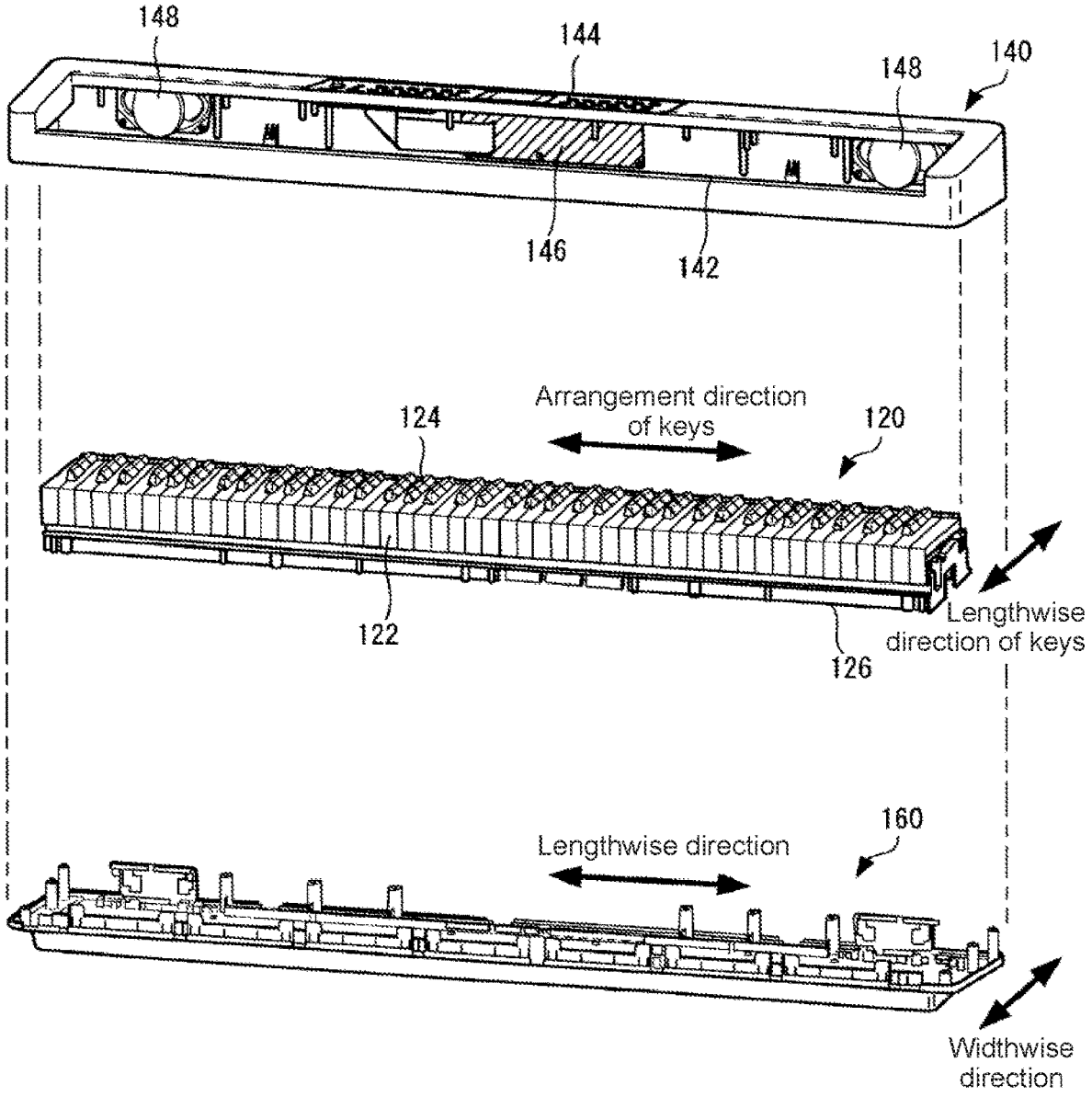
FIG. 2 is an assembly diagram schematically illustrating a configuration example of the keyboard instrument according to the embodiment.

FIGS. 1A-1B are an external view illustrating an embodiment of a keyboard instrument according to the present invention. Moreover, FIG. 2 is an assembly diagram schematically illustrating a configuration example of the keyboard instrument according to the present embodiment. Although here an electronic piano will be described as an example of the keyboard instrument, any other electronic musical instrument that has a casing extending in a direction designated as the lengthwise direction and that emits musical sounds in accordance with keypress operations from a user (performer) may be used.

As illustrated in FIGS. 1A and 1B, for example, the keyboard instrument according to the present invention includes a main instrument unit 100 of an electronic piano and a stand 200 on which and to which the main instrument unit 100 is rested and affixed. Here, as illustrated in FIG. 1B, for example, the main instrument unit 100 has formed on the bottom surface side thereof positioning recesses (described in more detail later) which mate with positioning protrusions 202 formed on the stand 200 side so that the main instrument unit 100 rests on the upper surface of the stand 200 at a prescribed position. The main instrument unit 100 thusly positioned on the upper surface of the stand 200 is fastened to the upper surface of the stand 200 via fasteners such as screws or bolts (not illustrated in the figure).

As illustrated in FIGS. 1A, 1B, and 2, for example, the main instrument unit 100 generally includes a keyboard unit 120, an upper casing 140, and a lower casing 160. The keyboard unit 120 includes on a front side thereof (user side; the near side in the figures) a plurality of keys as musical performance controls, and the user performs keypress operations to specify pitches.

The upper casing 140 includes a frame having an opening 142 which exposes the keys of the keyboard unit 120, and on the upper surface of the frame on the rear side (far side in the figures) of the opening 142, a control panel 144 including switches for performing operations such as adjusting volume or selecting tone color as well as a display panel or the like for displaying information about the music currently being performed or various types of settings information or the like is arranged. Furthermore, a sound source circuit board 146 which generates musical sounds in accordance with the pitches specified by keypress operations from the user and speakers 148 or the like which emit the generated musical sounds are installed into the upper casing 140. In the lower casing 160, the inner surface side (upper surface side in the figures) is connected to the keyboard unit 120 and the upper casing 140, and the outer surface side (lower surface side in the figures) has formed therein positioning recesses and screw holes for resting and affixing on and to the stand 200.

As illustrated in FIGS. 1A, 1B, and 2, in the keyboard unit 120, a plurality of white keys 122 and black keys 124 are regularly arranged in a prescribed order in the lengthwise direction (left-right direction in the figures) of the main instrument unit 100. Here, a total of 88 white keys 122 and black keys 124 are arranged in the keyboard unit 120. These white keys 122 and black keys 124 are attached to a common keyboard chassis 126 so as to be individually rotatable in the vertical direction. In the keyboard unit 120, the keyboard portion on the front side (near side in the figures) that is exposed from the opening 142 in the upper casing 140 is the region in which the user performs keypress operations, and the rear side (far side in the figures) is housed within the upper casing 140. Note that in the present specification, the term "key" refers generally to both white keys and black keys unless specifically noted otherwise.

Figure 3A:
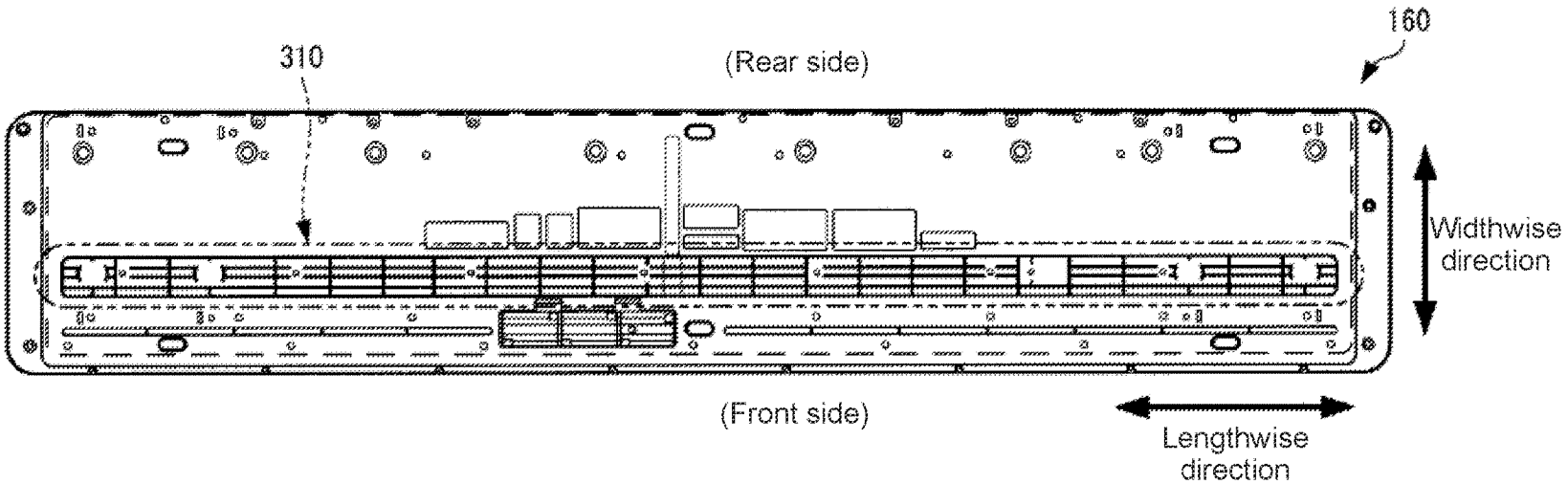
FIGS. 3A-3B schematically illustrate a lower casing used in the keyboard instrument according to the embodiment.
Figure 3B:
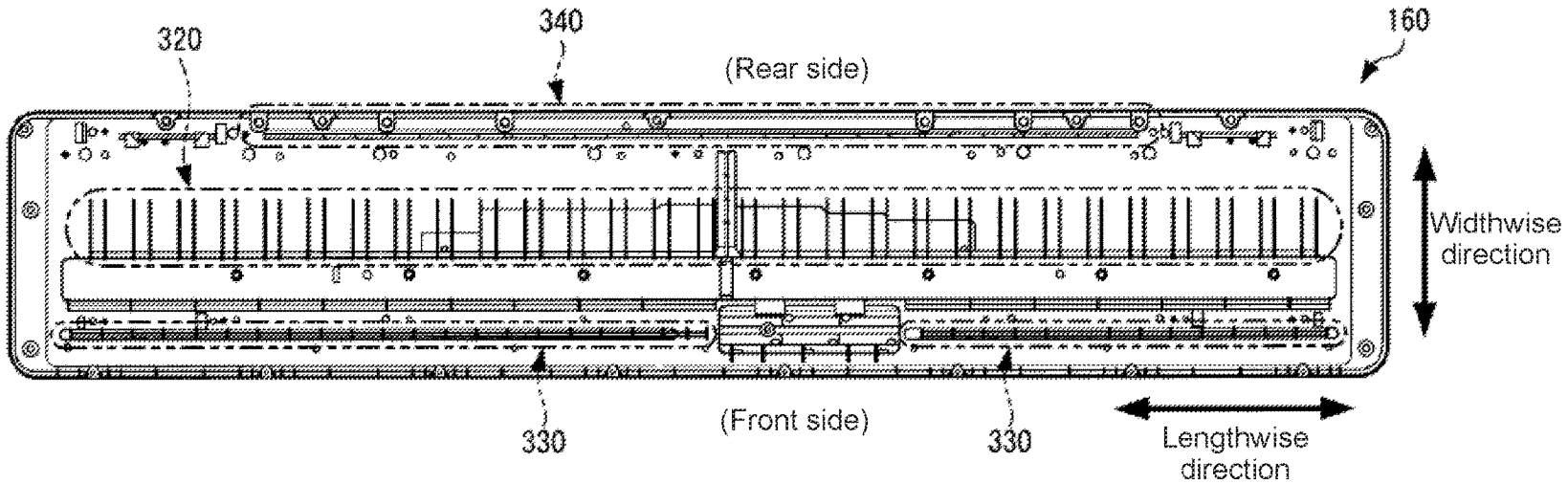

FIGS. 3A-3B schematically illustrates the lower casing used in the keyboard instrument according to the present embodiment. FIG. 3A is a view illustrating the outer surface side of the lower casing, and FIG. 3B is a view illustrating the inner surface side of the lower casing. Here, the outer surface side of the lower casing corresponds to the lower surface side of the main instrument unit 100 illustrated in FIGS. 1A, 1B, and 2, and the inner surface side of the lower casing corresponds to the interior side of the main instrument unit 100 and to the upper surface side of the lower casing 160 illustrated in FIG. 2.

As illustrated in FIGS. 3A-3B, in the present embodiment a plurality of casing reinforcing sections 310 to 340 of different types are formed in the lower casing 160 in order to improve the strength of the casing of the keyboard instrument. Each of the casing reinforcing sections 310 to 340 includes a plurality of ribs constituted by plate-shaped members running in the lengthwise direction of the main instrument unit 100 or the lower casing 160 and in the widthwise direction of the main instrument unit 100 or the lower casing 160 which is orthogonal to the lengthwise direction. Here, as illustrated in FIGS. 2, 3A, and 3B, the lengthwise direction of the main instrument unit 100 or the lower casing 160 corresponds to the arrangement direction of the keys of the keyboard unit 120, and the widthwise direction of the main instrument unit 100 or the lower casing 160 corresponds to the lengthwise direction of the keys which is orthogonal to the arrangement direction of the keys and in which the upper surfaces of the keys of the keyboard unit 120 extend.

Next, the each of the casing reinforcing sections 310 to 340 will be described in detail.

(1) First Casing Reinforcing Section 310

Figure 4:
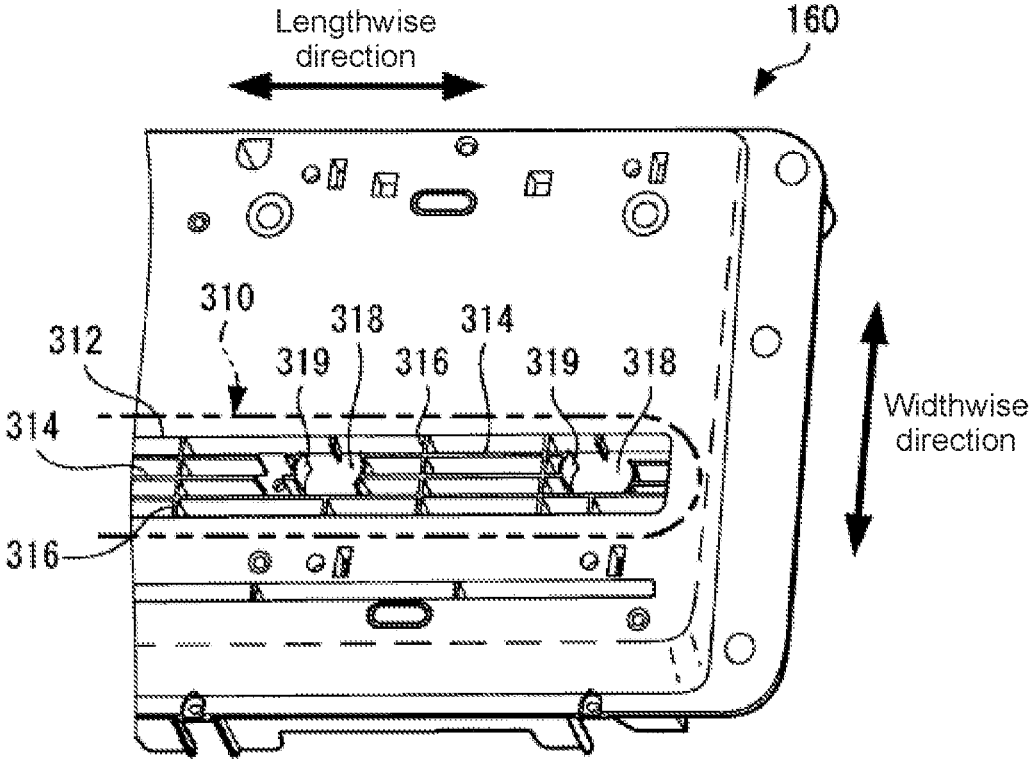
FIG. 4 is a perspective view illustrating the primary components of a first casing reinforcing section used in the keyboard instrument according to the embodiment.
Figure 5:
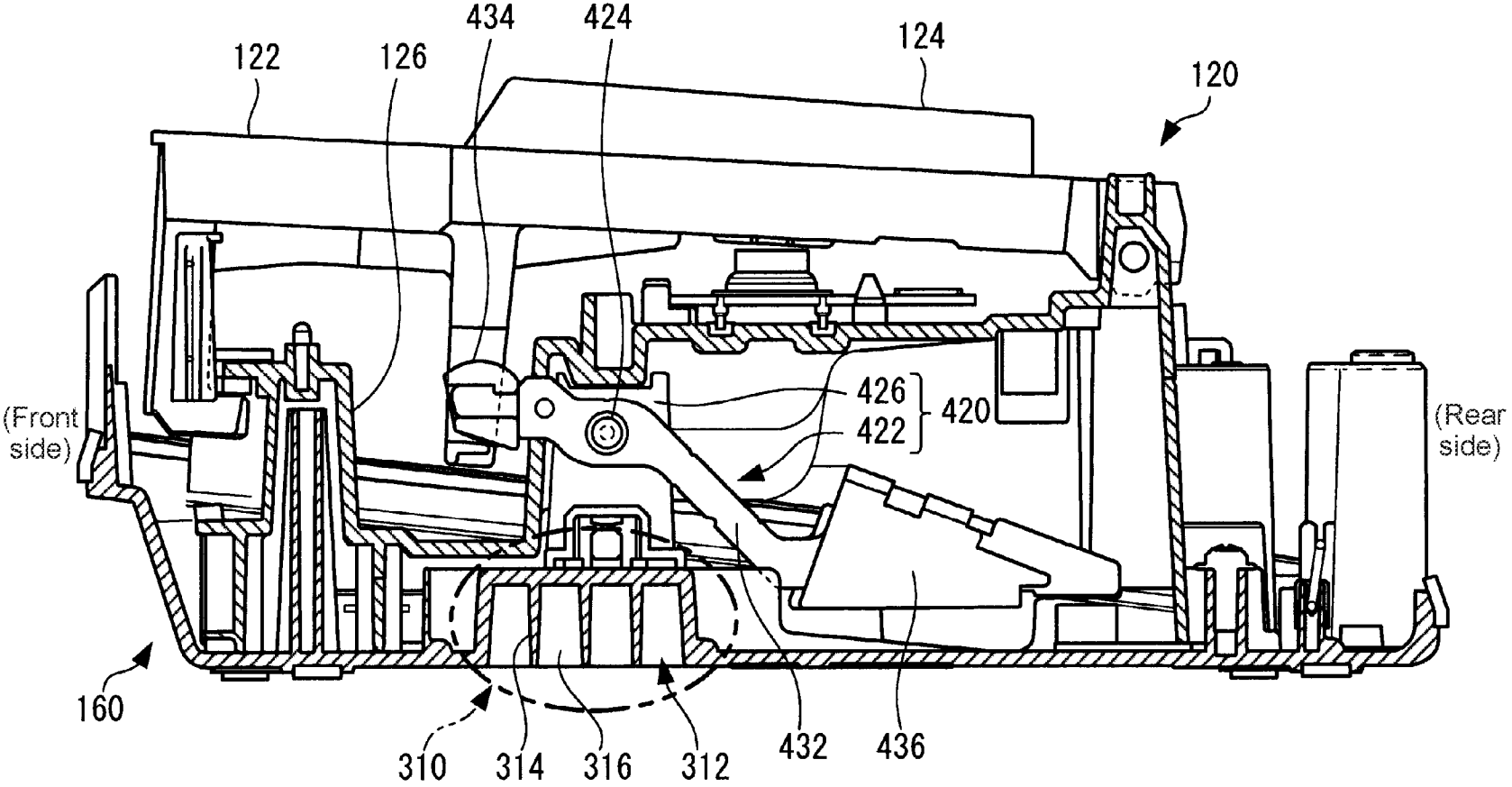
FIG. 5 is a cross-sectional view illustrating the primary components of a main instrument unit to which the first casing reinforcing section according to the embodiment has been applied.

FIG. 4 is a perspective view illustrating the primary components of a first casing reinforcing section used in the keyboard instrument according to the present embodiment, and FIG. 5 is a cross-sectional view illustrating the primary components of the main instrument unit to which the first casing reinforcing section according to the present embodiment has been applied. Note that the cross-section illustrated in FIG. 5 omits the upper casing in order to simplify the illustration.

More specifically, as illustrated in FIG. 3A, in the first casing reinforcing section 310, a continuous channel 312 is formed in a region (first region) extending in the lengthwise direction of the lower casing 160. As illustrated in FIGS. 4 and 5, the channel 312 has a recess which is recessed going from the outer surface side of the lower casing 160 towards the interior direction of the main instrument unit 100 (the inner surface side of the lower casing 160), and within the channel 312, ribs 314 including a plurality of plate-shaped members extending in the lengthwise direction of the lower casing 160 and ribs 316 including a plurality of plate-shaped members extending in the widthwise direction of the lower casing 160 orthogonal to the lengthwise direction are arranged in a grid pattern. Here, as illustrated in FIGS. 4 and 5, the ribs 314 and 316 have a height that is substantially equal to the depth of the channel 312 and are formed integrally within the channel 312.

In this way, by forming the channel 312 which extends in the lengthwise direction of the lower casing 160 and forming the ribs 314 and 316 arranged in a grid pattern within that channel 312, even if the wall thickness of these components is designed to be thin in order to reduce the size and weight of the main instrument unit 100, deformation (bending) in the direction orthogonal to the lengthwise direction of the lower casing 160 and the main instrument unit 100 that includes the lower casing 160 can be inhibited, and the strength of the casing can be improved. Moreover, by increasing the width of the channel 312 in the widthwise direction of the lower casing 160 and also forming the ribs 316 to be longer in accordance with that width, deformation (twisting) in a rotational direction about the lengthwise direction of the lower casing 160 and the main instrument unit 100 can be inhibited, and the strength of the casing can be further improved.

Furthermore, as illustrated in FIG. 4, in the first casing reinforcing section 310, positioning members for resting the main instrument unit 100 at a prescribed position on the upper surface of the stand 200 are formed within the channel 312 of the lower casing 160. When positioning protrusions 202 are formed on the stand side as illustrated in FIGS. 1A-1B, for example, positioning recesses 318 which mate with the positioning protrusions 202 on the upper surface of the stand 200 are formed within the channel 312 formed on the outer surface side of the lower casing 160. The positioning recesses 318 are formed at a plurality of locations near both ends of the channel 312 that extends in the lengthwise direction of the lower casing 160. Here, the positioning recesses 318 are formed by configuring the arrangement, shape, height, and the like of the ribs 314 and 316 in the channel 312 so as to correspond to the shape, height, and the like of the positioning protrusions 202 on the stand side. As illustrated in FIG. 4, when the positioning protrusions 202 on the stand 200 side have a cylindrical shape, for example, the positioning recesses 318 are formed by removing the ribs 314 and 316 in the portions that will mate with the cylindrical positioning protrusions 202 and forming arc-shaped supporting ribs (supporting portions) 319 so as to fit onto the cylindrical outer peripheral surfaces of the positioning protrusions 202.

In this way, when rested on and affixed to the stand 200, the main instrument unit 100 can be easily and reliably positioned using the positioning recesses 318 formed in the channel 312. Here, forming the ribs 314 and 316 in a grid pattern within the channel 312 improves the strength of the lower casing 160, which makes it possible to inhibit changes or shifts in the positions of the positioning recesses 318 resulting from deformation of the lower casing 160 or the main instrument unit 100 and also makes it possible to easily and reliably rest and affix the main instrument unit 100 on and to the stand 200 at a prescribed position.

Moreover, as illustrated in FIG. 5, in the first casing reinforcing section 310 the channel 312 is formed recessing from the outer surface side of the lower casing 160 towards the interior direction of the main instrument unit 100, and therefore a protruding portion (protrusion) corresponding to the shape of the channel 312 is formed within the main instrument unit 100 (on the inner surface side of the lower casing 160). In the present embodiment, the shapes and dimensions of the protrusion (channel 312) and a hammer holder 426 (supporting member) which rotatably supports hammers 422 arranged corresponding to the keys of the keyboard unit 120 are configured such that the lower end (in the figure) of the hammer holder 426 rests on the upper surface (in the figure) of the protrusion. Here, with the hammer holder 426 resting on the protrusion (channel 312), these components are fastened together using fasteners such as screws in order to install the keyboard unit 120 including the hammer holder 426 into the lower casing 160.

This makes it possible to use the protrusion corresponding to the channel 312 to support the hammer holder 426 from below when installing the keyboard unit 120 into the lower casing 160. Here, the ribs 314 and 316 formed in a grid pattern within the channel 312 improve the strength of the lower casing 160, which makes it possible to inhibit deformation of the lower casing 160 and the main instrument unit 100 resulting from the weight of the keyboard unit 120 and from impacts or pressing forces accompanying keypresses. Moreover, the protrusion (channel 312) and the hammer holder 426 are fastened together, which makes it possible to suppress abnormal noises and vibrations accompanying the rotation of the hammers when keys are pressed. The keyboard mechanism of the keyboard unit 120 will be described in more detail later.

Although in the present embodiment the ribs 314 and 316 are described as being arranged within the channel 312 in a grid pattern having quadrilateral spaces, the present invention is not limited to this configuration. Any configuration in which the ribs of the first casing reinforcing section 310 increase the casing strength in both the lengthwise direction and the widthwise direction of the lower casing 160 is possible, and as other examples of reinforcing structures, configurations in which the ribs 314 and 316 are arranged within the channel 312 in a truss pattern having triangular spaces or in a honeycomb pattern having hexagonal spaces may be used.

Moreover, although the present embodiment describes a configuration in which, as the first casing reinforcing section 310, the channel 312 having a recess which is recessed going from the outer surface side of the lower casing 160 towards the interior direction of the main instrument unit 100 is formed and the ribs 314 and 316 are arranged in a grid pattern within the channel 312, the present invention is not limited to this configuration. As the first casing reinforcing section 310, rather than forming the channel 312, ribs arranged in a grid pattern in a region on the inner surface side of the lower casing 160 (interior side of the main instrument unit 100) corresponding to the region in which the abovementioned channel 312 is formed may protrude out and may extend along the lengthwise direction of the lower casing 160. Similar to the embodiment described above, this configuration also makes it possible to improve the strength of the lower casing 160. Here, the lengthwise and widthwise ends of the ribs arranged in a grid pattern may be connected together via a frame-shaped rib arranged surrounding the outer periphery of the ribs. This allows the frame-shaped rib to serve the same function as the sidewalls of the channel 312 in the embodiment described above, thereby making it possible to further improve the strength of the casing.

(2) Second Casing Reinforcing Section 320

Figure 6:
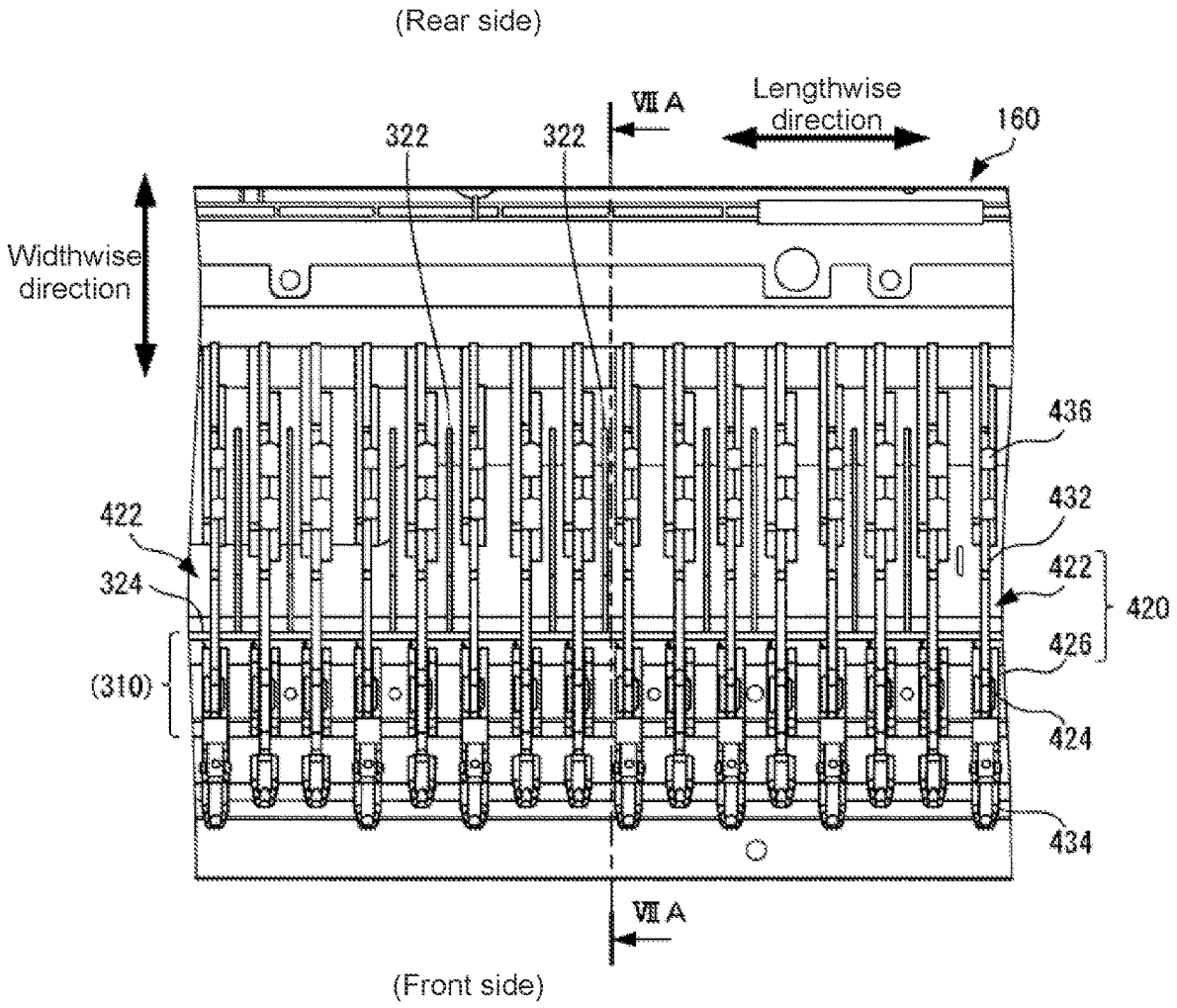
FIG. 6 is a plan view illustrating the primary components of a second casing reinforcing section used in the keyboard instrument according to the embodiment.
Figure 7:
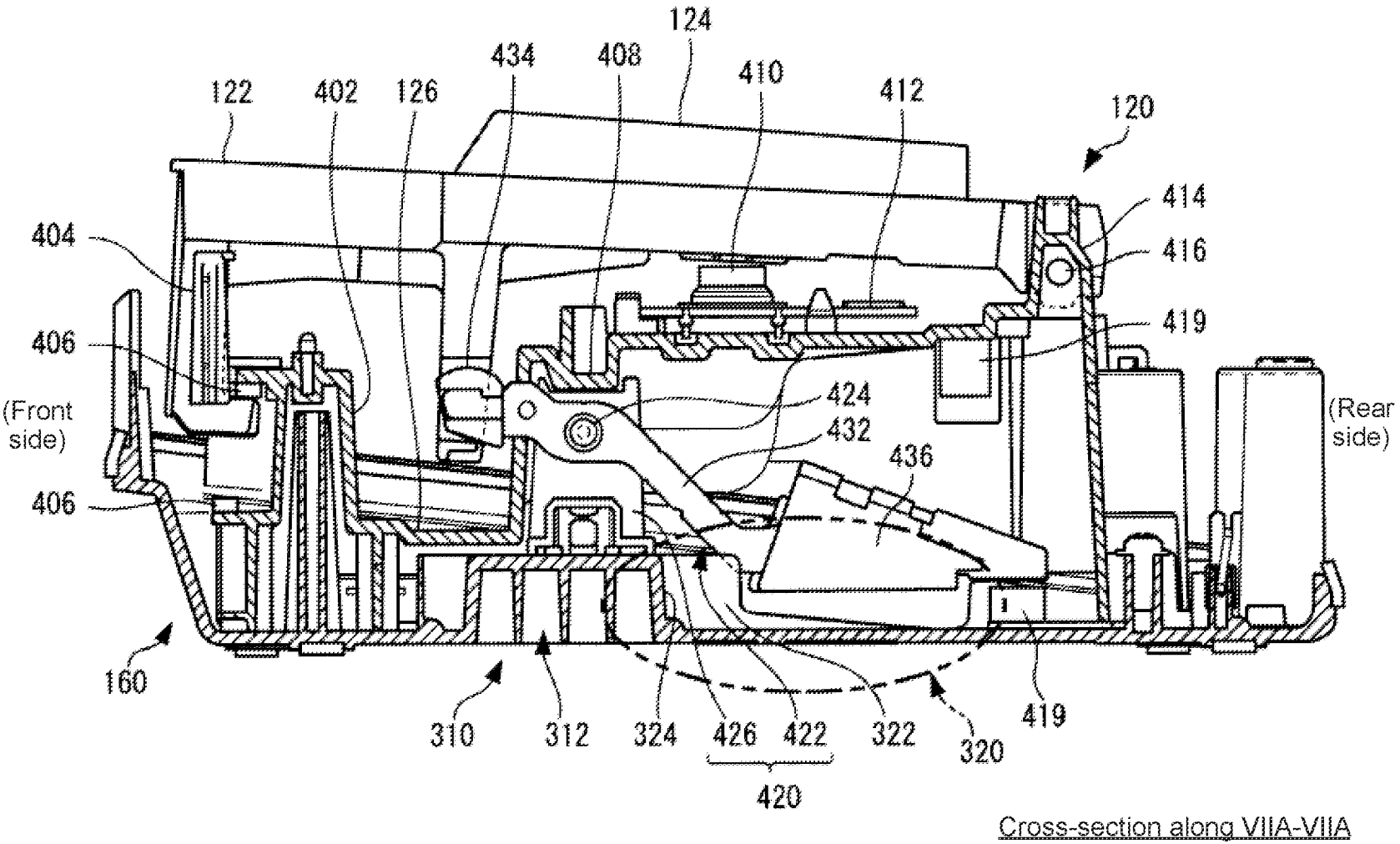
FIG. 7 is a (first) cross-sectional view illustrating the primary components of a keyboard mechanism of the main instrument unit to which the second casing reinforcing section according to the embodiment has been applied.
Figure 8:
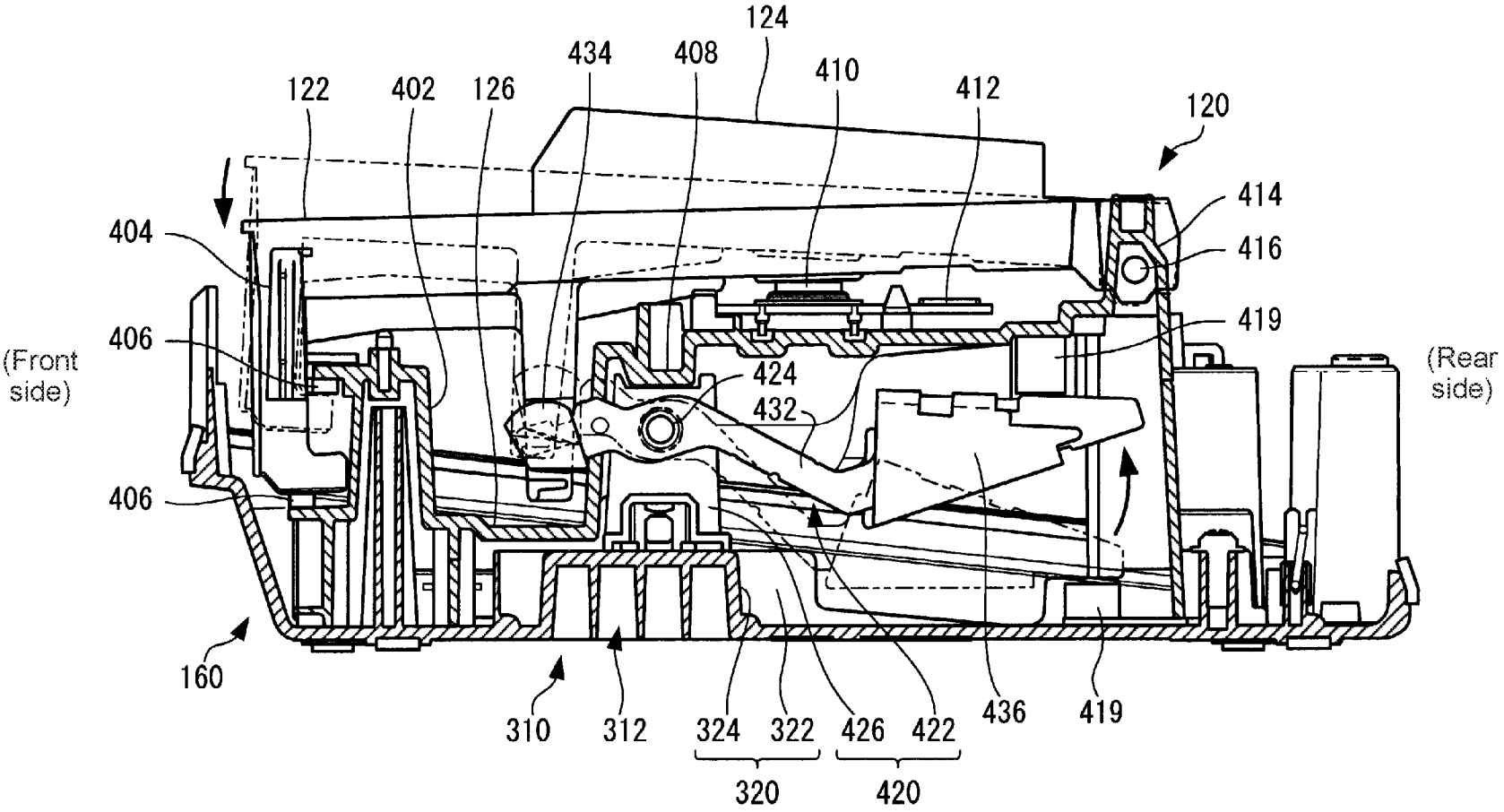
FIG. 8 is a (second) cross-sectional view illustrating the primary components of the keyboard mechanism of the main instrument unit to which the second casing reinforcing section according to the embodiment has been applied.
Figure 9A:
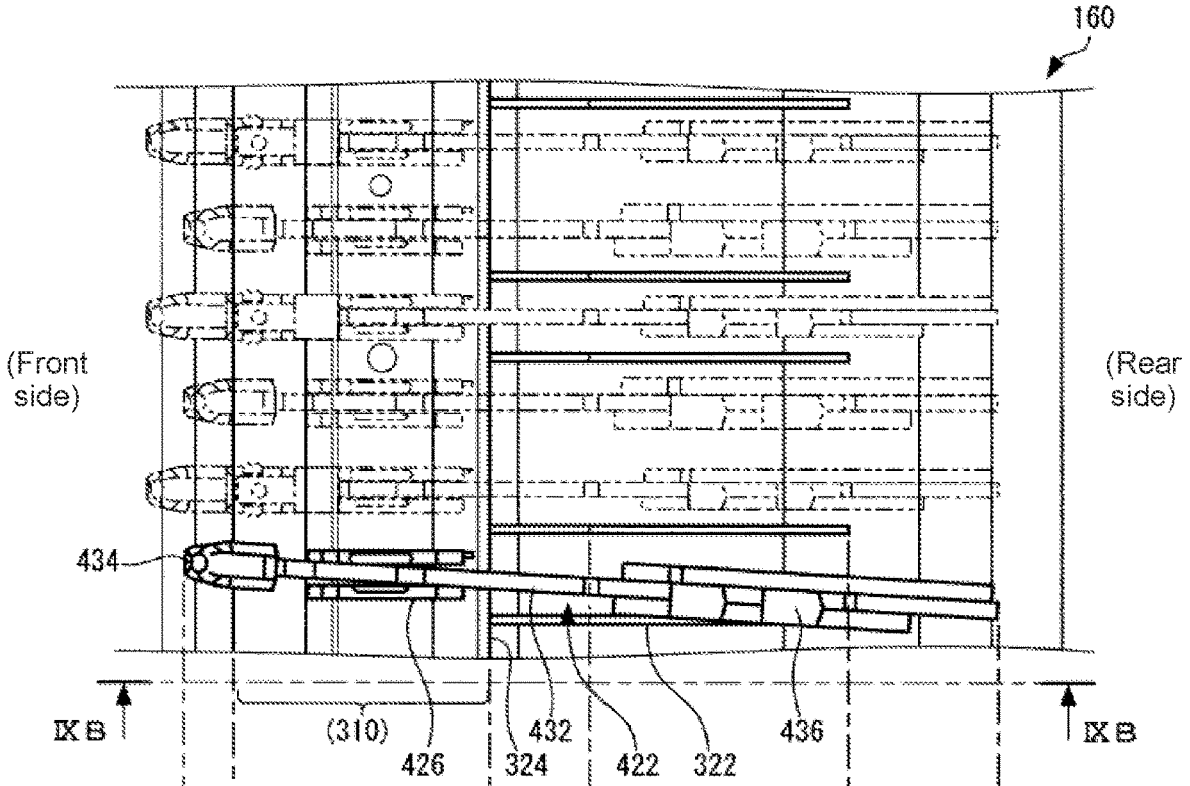
FIGS. 9A and 9B illustrate an example of interference between hammers and ribs of the second casing reinforcing section used in the keyboard instrument according to the embodiment.
Figure 9B:
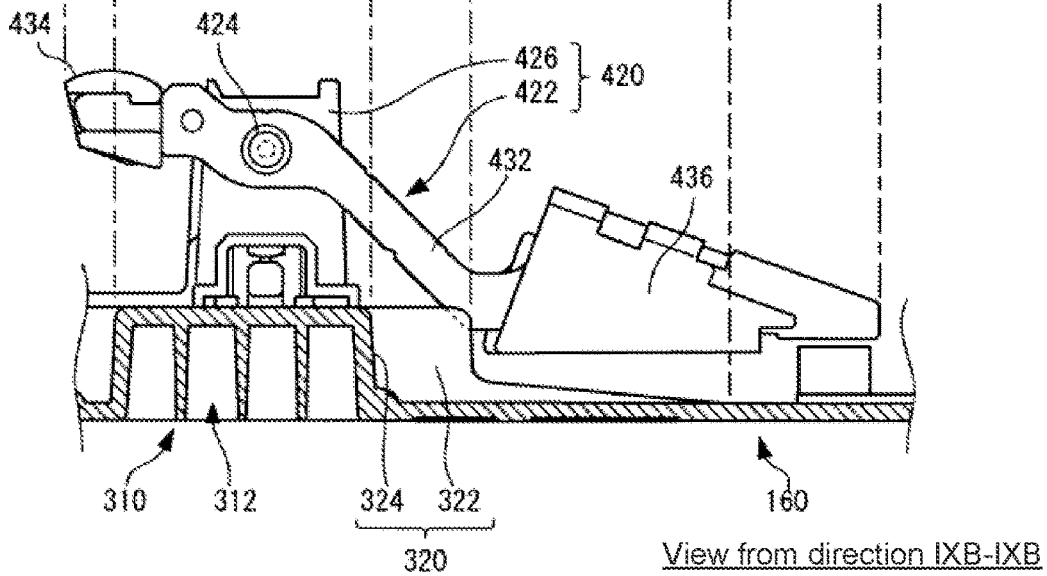
Figure 10:
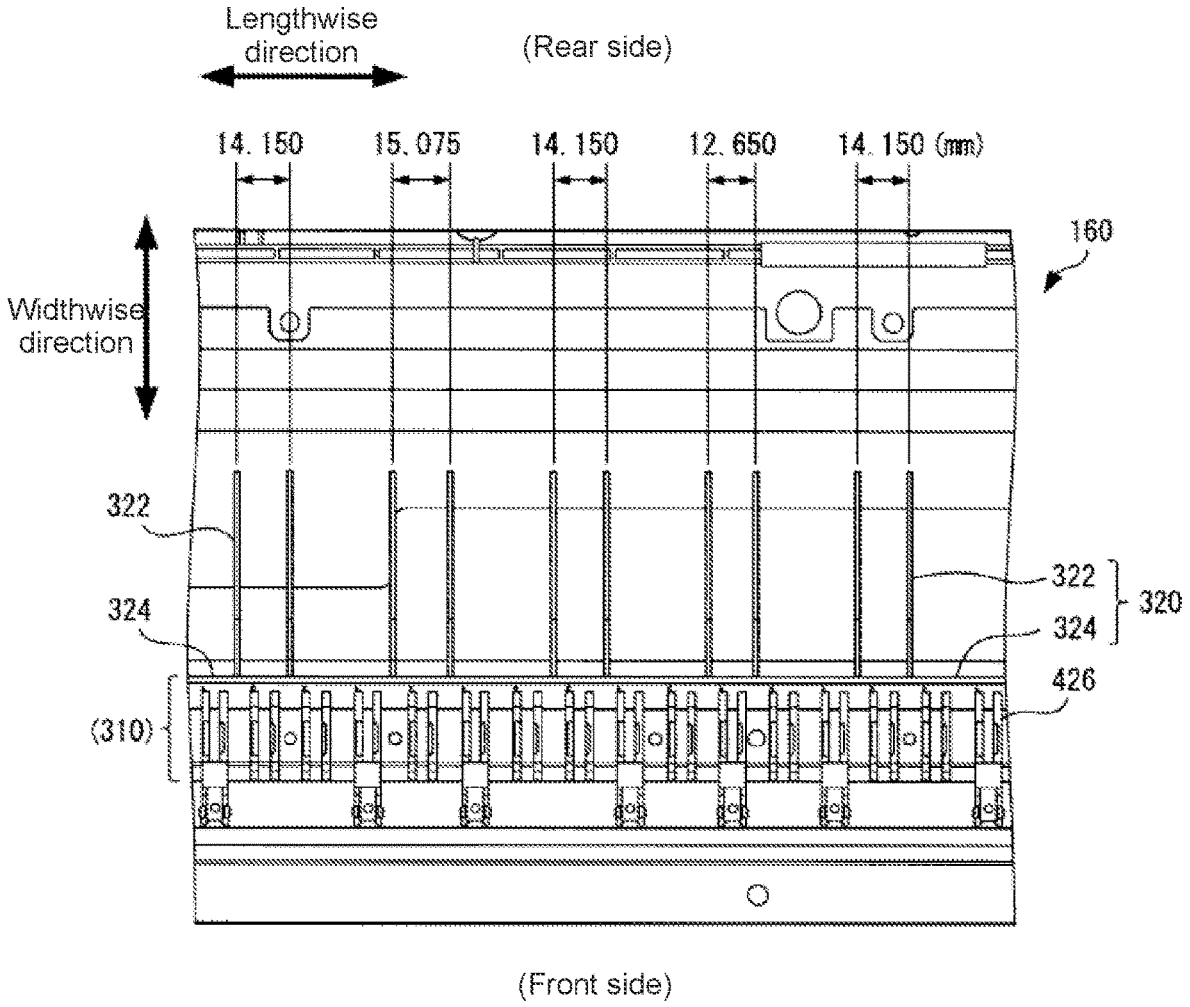
FIG. 10 is a plan view illustrating an example of arrangement gaps between the ribs of the second casing reinforcing section used in the keyboard instrument according to the embodiment.

FIG. 6 is a plan view illustrating the primary components of a second casing reinforcing section used in the keyboard instrument according to the present embodiment, and FIGS. 7 and 8 are cross-sectional views illustrating the primary components of the keyboard mechanism of the main instrument unit to which the second casing reinforcing section according to the present embodiment has been applied. Note that the cross-sections illustrated in FIGS. 7 and 8 omit the upper casing in order to simplify the illustrations. FIGS. 9A-9B illustrates an example of interference between hammers and ribs of the second casing reinforcing section used in the keyboard instrument according to the present embodiment. FIG. 10 is a plan view illustrating an example of arrangement gaps between the ribs of the second casing reinforcing section used in the keyboard instrument according to the present embodiment.

More specifically, as illustrated in FIGS. 3B and 6, in the second casing reinforcing section 320, ribs (reinforcing members) 322 including one or more plate-shaped members extending in the widthwise direction of the lower casing 160 are arranged on the inner surface side of the lower casing 160 in regions corresponding to gaps between the hammers 422 arranged corresponding to the respective white keys 122 and black keys 124 arranged in the keyboard unit 120. Moreover, in the second casing reinforcing section 320, a rib 324 which connects together the plurality of ribs 322 extending in the widthwise direction is arranged extending in the lengthwise direction of the lower casing 160 orthogonal to the widthwise direction of the lower casing 160. As illustrated in FIGS. 6 and 7, in the present embodiment, on one end side (lower end side in FIG. 6; left end side in FIG. 7) the ribs 322 extending in the widthwise direction of the lower casing 160 protrude out towards the inner surface side of the lower casing 160 in a manner corresponding to the shape of the channel 312 formed in the first casing reinforcing section 310 described above and are connected to a sidewall of the protrusion extending in the lengthwise direction. In other words, the one or more ribs 322 are formed in a region (second region) that is adjacent to the region (first region) in which the channel 312 of the lower casing 160 is formed, and the sidewall of the protrusion corresponding to the channel 312 functions as the rib 324 and connects together the plurality of ribs 322 in the lengthwise direction.

Here, in order to better describe the second casing reinforcing section 320, the keyboard mechanism of the keyboard unit used in the present embodiment will be described. Although here the keyboard mechanism for the white keys 122 will be described, the black keys 124 have the same keyboard mechanism.

As illustrated in FIG. 7, the keyboard mechanism of the keyboard unit includes the common keyboard chassis 126 to which the white keys 122 and the black keys 124 are attached so as to be rotatable in the vertical direction, a hammer unit 420 for providing action weight to keypress operations on each of the white keys 122 and the black keys 124 attached to the keyboard chassis 126, and switches 410 which switch ON in accordance with keypress operations on the white keys 122 and the black keys 124.

On the front side edge (left edge in the figure) of the keyboard chassis 126 (the user side of the main instrument unit 100), a front leg 402 is formed protruding upwards in the figure towards the white keys 122. On an upper portion of the front leg 402, key guides 404 for preventing lateral shifting in the arrangement direction of the keys (the direction orthogonal to the page in the figure) when the white keys 122 rotate are formed, and on the front side (left side in the figure) of the front leg 402, stoppers 406 for constraining the uppermost positions and lowermost positions of the white keys 122 when rotating are formed. Moreover, on the rear side (right side in the figure) of the front leg 402 of the keyboard chassis 126, a unit attaching portion 408 to which the hammer unit 420 is attached is formed protruding upwards in the figure.

Furthermore, on the rear side (right side in the figure) of the unit attaching portion 408 of the keyboard chassis 126, a sound emission board 412 having mounted thereon the switches 410 that switch ON in accordance with keypress operations on the white keys 122 is installed. On the sound emission board 412, a plurality of the switches 410 are provided for both the white keys 122 and the black keys 124 that are arranged in a line, and these switches 410 are mounted individually corresponding to the white keys 122 and the black keys 124 above the sound emission board 412. Moreover, a processing circuit which generates musical sound information on the basis of ON signals output from the switches 410 in accordance with keypress operations on the white keys 122 is also mounted on the sound emission board 412.

Furthermore, a key attaching portion 414 is formed further on the rear side (right side in the figure) than the board installation portion of the keyboard chassis 126, and the rear ends of the white keys 122 (right ends in the figure) are attached to the key attaching portion 414 via support shafts 416 which support the white keys 122 so as to be rotatable in the vertical direction. In addition, on the rear edge (right edge in the figure) of the keyboard chassis 126, a rear leg 418 is formed extending down from the key attaching portion 414. On this rear leg 418, stoppers 419 for constraining the uppermost positions and lowermost positions of the hammers 422 of the hammer unit 420 when rotating in accordance with keypress operations on the white keys 122 are formed.

As illustrated in FIGS. 6 and 7, the hammer unit 420 includes the plurality of hammers 422 which are arranged corresponding to the respective white keys 122 and black keys 124 and individually rotate in accordance with keypress operation on the keys, thereby providing action weight, as well as the hammer holder 426 which is formed in common for the white keys 122 and the black keys 124 and supports the hammers 422 corresponding to the keys via support shafts 424 so as to be individually rotatable. As illustrated in FIG. 7, the hammer holder 426 is attached to the lower surface side of the unit attaching portion 408 of the keyboard chassis 126 described above.

As illustrated in FIG. 7, each hammer 422 includes a main hammer unit 432 made of a metal material, a key-engaging portion 434 (force application point) formed on one end side (left end side in FIG. 7) of the main hammer unit 432, a weight 436 (weighted point) formed on the other end side (right end side in FIG. 7) of the main hammer unit 432, and a support shaft 424 which is formed between the weight 436 and the key-engaging portion 434 of the main hammer unit 432 and rotatably supports the main hammer unit 432. Here, as illustrated in FIGS. 6 and 7, the weights 436 of the hammers 422 are formed to have larger planar shapes as viewed from the lengthwise direction of the lower casing 160 (arrangement direction of the keys) and greater thicknesses in the lengthwise direction of the lower casing 160 (arrangement direction of the keys) than the main hammer units 432 between the weights 436 and the support shafts 424, thereby setting weights for providing prescribed action weights to the keys. Note that although the hammers 422 have substantially the same shapes for white keys and for black keys, keypress positions of keypress operations as well as key shape and the like are different for the white keys 122 and the black keys 124, and therefore the planar shapes, thicknesses, weights, dimensions from the support shaft 424 to the weight 436 and to the key-engaging portion 434, and the like of the hammers 422 are designed to be slightly different.

As illustrated in FIG. 7, in the main instrument unit 100 including the keyboard unit 120 having the keyboard mechanism described above, when the user is not performing any keypress operations (initial state), the hammers 422 are biased by the weight of the weights 436 to rotate clockwise about the support shafts 424, and the weights 436 are constrained to lowermost positions by virtue of contacting the lowermost stopper 419 formed in the keyboard chassis 126. Moreover, the key-engaging portions 434 of the hammers 422 press the keys upward, thereby setting the keys to their initial positions (uppermost positions).

When the user then performs a keypress operation, as illustrated in FIG. 8, the white key 122 or black key 124 rotates counterclockwise about the support shaft 416. As a result, the key-engaging portion 434 of the hammer 422 is pressed downward by the key, the hammer 422 rotates counterclockwise about the support shaft 424 and causes the weight 436 to rise, and the action weight based on the weight of the weight 436 is applied to the key. Then, as the keypress operation proceeds and the key-engaging portion 434 of the hammer 422 is pressed further downwards by the key, the weight 436 of the hammer 422 rises further and contacts the uppermost stopper 419 formed in the keyboard chassis 126, thereby stopping the rotation of the hammer 422 and constraining the uppermost position thereof, and the lowermost position of the key is constrained (lowermost key state).

In this keypress operation, during the period before the weight 436 of the hammer 422 contacts the uppermost stopper 419, the switch 410 mounted on the keyboard chassis 126 is depressed by the key and switches ON, thereby causing musical sound information corresponding to that key to be generated. On the basis of this musical sound information, a musical sound is generated by the sound source circuit installed into the upper casing 140 and is then emitted from the speakers 148. Then, when the user completes the keypress operation, the hammer 422 rotates clockwise under the weight of the weight 436, the weight 436 contacts the lowermost stopper 419 and is constrained to the lowermost position, and the key-engaging portion 434 presses the key upwards and sets the key to its initial position (uppermost position). In this way, in the hammers 422, the weights 436 and the key-engaging portions 434 respectively move about the support shafts 424 in the vertical direction in a rocking manner.

As illustrated in FIG. 6, in the second casing reinforcing section 320 of the lower casing into which the keyboard unit having the keyboard mechanism described above is installed, at least one rib (reinforcing member) 322 is arranged extending in the widthwise direction of the lower casing 160 in a region corresponding to gaps between the hammers 422 arranged corresponding to the respective white keys 122 and black keys 124. Here, the ribs 322 are formed integrally using the same or a similar resin material as the lower casing 160. The shape, height, and thickness dimensions of the ribs 322 formed in the gaps between the hammers 422 are set such that no interference (such as contacting, touching, or grinding) occurs on the paths of the hammers 422 illustrated in FIGS. 7 and 8 when rotating (rocking in the vertical direction) or within the range of lateral shifting in the arrangement direction of the keys (rocking in the lengthwise direction) as illustrated in FIGS. 9A-9B during such rotation or when the main instrument unit 100 is stood up vertically (or when the lengthwise direction of the main instrument unit 100 is otherwise treated as running up and down). Thus, if the keyboard instrument is placed vertically with one lateral end thereof being at a bottom and the other lateral end thereof being at a top, the weights of the hammers leaning downward due to gravity do not contact any of the reinforcing members. As illustrated in FIGS. 7 and 9B, for example, the ribs 322 have a planar shape in which the height (the dimension of protruding towards the inner surface side of the lower casing 160) decreases in a stepped manner or a continuous manner going from the front side (user side; the portion connected to the rib 324 on the left side in the figures) towards the rear side (right side in the figures), or have notched portions that are notched out.

In this way, as illustrated in FIG. 9A, even if the hammers 422 undergo significant lateral shifting in the arrangement direction of the keys (vertical direction in the figure), the heights of the ribs 322 are configured to be lower in the areas that the main hammer units 432 or weights 436 of the hammers 422 would otherwise contact, thereby making it possible to avoid interference between the hammers 422 and the ribs 322 and also making it possible to suppress abnormal noises and vibrations accompanying the rotation or lateral shifting of the hammers. Note that the ribs 322 can have any planar shape that prevents interference due to rotation or lateral shifting of the hammers 422 and may have a planar shape in which the height decreases continuously in a linear or curved manner, for example.

Moreover, as illustrated in FIGS. 6, 7, 9A, and 9B, in order to improve the strength of the casing, it is preferable that the number of ribs 322 arranged and the arrangement gaps between the ribs 322 be set such that the plurality of ribs 322 are uniformly or substantially uniformly distributed in the lengthwise direction of the lower casing 160, and it is also preferable that the lengths extending in the widthwise direction be set to be as long as possible. Here, as described above, the keypress positions of keypress operations as well as key shape and the like are different for the white keys 122 and the black keys 124 of the keyboard instrument, and therefore the planar shapes, thicknesses, weights, and the like of the hammers 422 arranged corresponding to the respective white keys 122 and black keys 124 are configured to be different. As a result, the paths and lateral shifting ranges of the hammers 422 when rotating are different for the white keys 122 and the black keys 124. Therefore, as illustrated in FIG. 10, in the present embodiment the plurality of ribs 322 are arranged regularly or substantially regularly in the lengthwise direction of the lower casing 160, and the arrangement gaps between the ribs 322 are set to be as equal as possible.

This makes it possible to arrange the plurality of ribs 322 regularly or substantially regularly in the lengthwise direction of the lower casing 160 and to also extend the ribs 322 to be as long as possible in the widthwise direction without causing interference on the rotation paths or lateral shifting ranges of the hammers 422 when keys are pressed, which in turn makes it possible to suppress abnormal noises and vibrations accompanying rotation of the hammers when keys are pressed as well as to inhibit deformation (bending) in the direction orthogonal to the widthwise direction of the lower casing 160 and the main instrument unit 100, and further makes it possible to improve the strength of the casing.

Moreover, as illustrated in FIGS. 7 and 9B, in the second casing reinforcing section 320, the ends on the front side (left side in the figures) of the plurality of ribs 322 extending in the widthwise direction of the lower casing 160, where the height (the dimension of protruding towards the inner surface side of the lower casing 160) is greatest, are connected to the sidewall of the protrusion protruding towards the inner surface side of the lower casing 160 as a result of the channel 312 being formed in the first casing reinforcing section 310 as described above.

As a result, the sidewall of the protrusion is utilized as the rib 324 and the plurality of ribs 322 are connected together in the lengthwise direction of the lower casing 160, which makes it possible to improve the strength of the ribs 322 extending in the widthwise direction of the lower casing 160, makes it possible to inhibit deformation (bending) in the direction orthogonal to the lengthwise direction of the lower casing 160 and the main instrument unit 100 as well as deformation (twisting) in a rotational direction about that lengthwise direction, and makes it possible to further improve the strength of the casing. Furthermore, in this case a portion of the structure of the first casing reinforcing section 310 (the sidewall of the protrusion) is also used in the structure of the second casing reinforcing section 320 (the rib 324), which makes it possible to reduce the space required for component layout within the main instrument unit 100.

(3) Third Casing Reinforcing Section 330

Figure 11A:
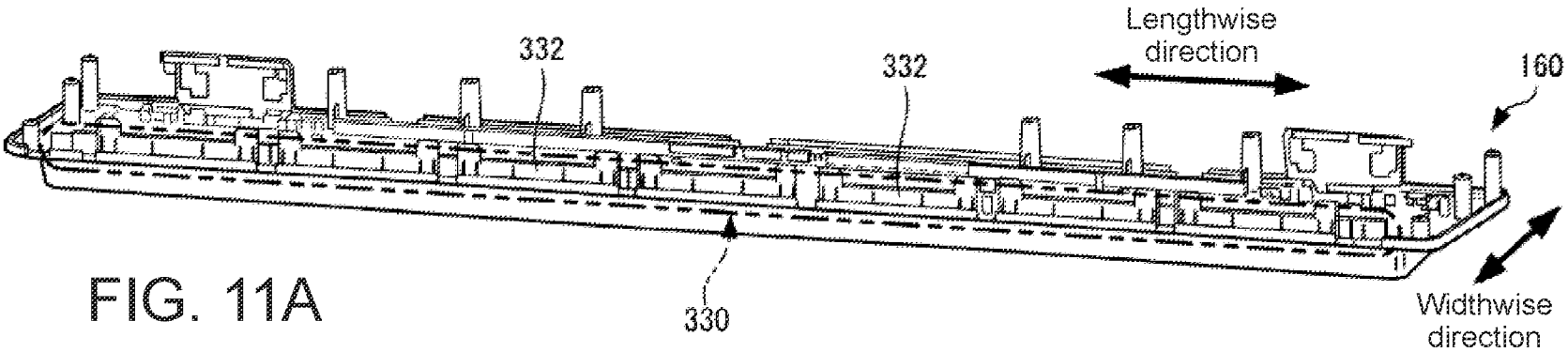
FIGS. 11A and 11B are perspective views schematically illustrating a third casing reinforcing section used in the keyboard instrument according to the embodiment.
Figure 11B:
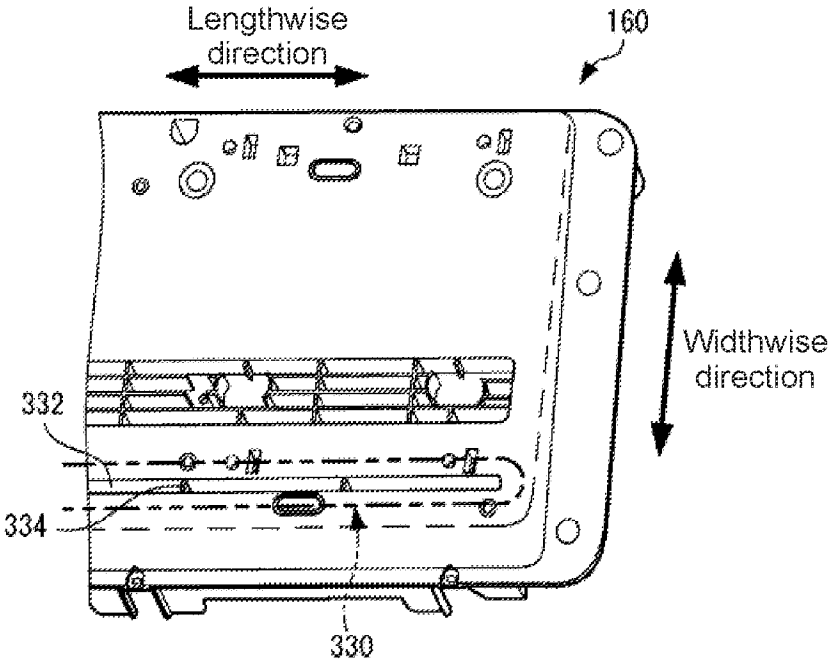
Figure 12:
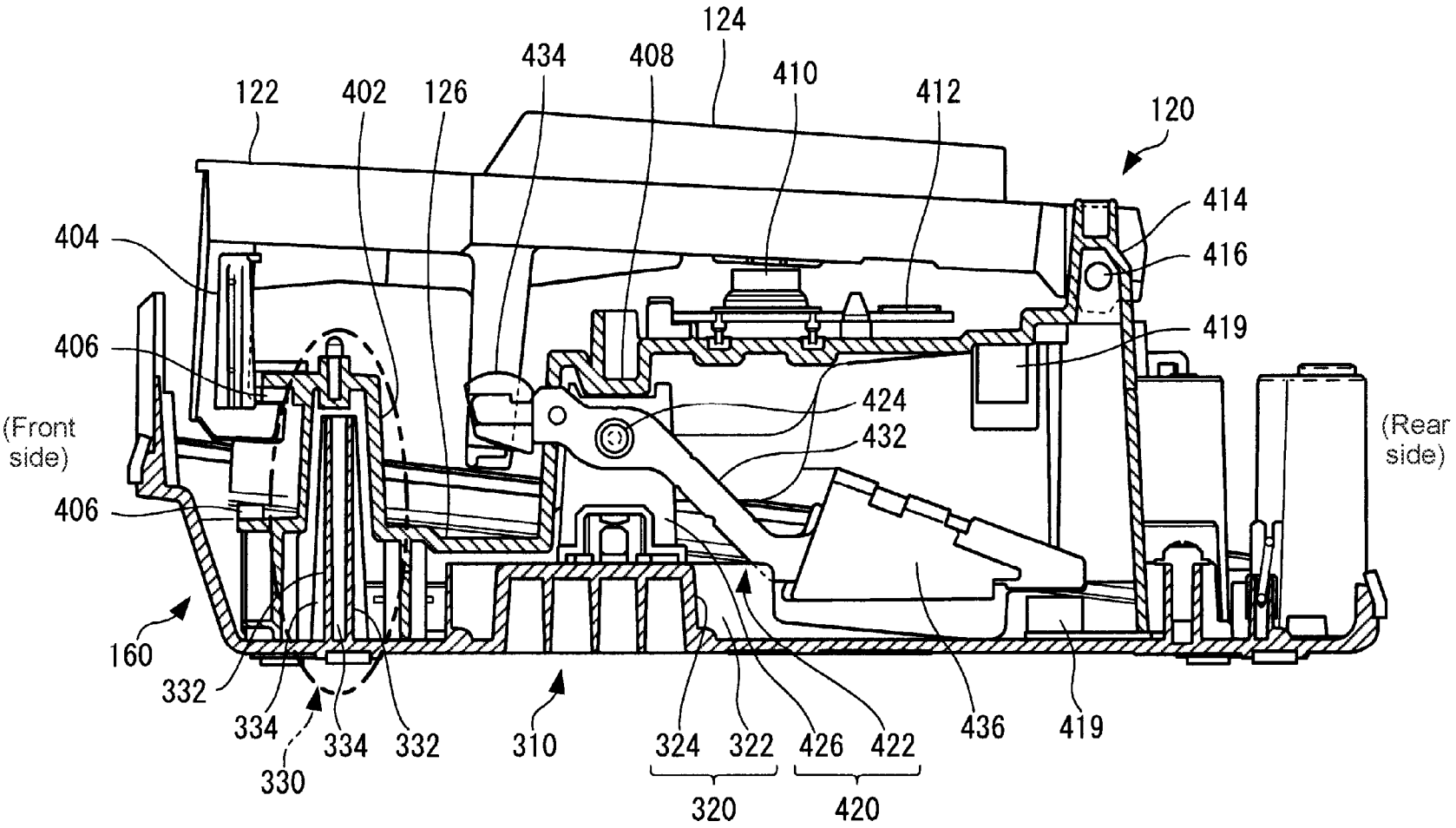
FIG. 12 is a cross-sectional view schematically illustrating the main instrument unit to which the third casing reinforcing section according to the embodiment has been applied.

FIGS. 11A-11B are a perspective view schematically illustrating a third casing reinforcing section used in the keyboard instrument according to the present embodiment. FIG. 11A is an overall perspective view illustrating the lower casing to which the third casing reinforcing section has been applied, and FIG. 11B is a perspective view illustrating the primary components on the outer surface side of the lower casing. FIG. 12 is a cross-sectional view schematically illustrating the main instrument unit to which the third casing reinforcing section according to the present embodiment has been applied. Note that the cross-section illustrated in FIG. 12 omits the upper casing in order to simplify the illustration.

More specifically, as illustrated in FIGS. 3B, 11A, 11B, and 12, the third casing reinforcing section 330 includes, in a region (third region) which extends in the lengthwise direction of the lower casing 160 and is a region on the front side (lower side in FIG. 3B; near side in FIGS. 11A-11B) in the widthwise direction corresponding to the keypress positions of the white keys 122 arranged in the keyboard unit 120, a recess which is recessed going from the outer surface side of the lower casing 160 towards the interior direction of the main instrument unit 100 (the inner surface side of the lower casing 160). More particularly, on the inner surface side of the lower casing 160, ribs 332 including a pair of plate-shaped members arranged near to and facing one another and running in the lengthwise direction of the lower casing 160 as well as ribs 334 including plate-shaped members which extend in the widthwise direction of the lower casing 160 orthogonal to the lengthwise direction and connect together the pair of ribs 332 are arranged, for example. Here, as illustrated in FIG. 12, the ribs 332 and 334 are formed protruding upwards in the figure from the inner surface side of the lower casing 160 towards the white keys 122 of the keyboard unit 120, but the shapes and heights of the ribs 332 and 334 are set such that a gap is formed between the keyboard chassis 126 of the keyboard unit 120 and the upper ends of the ribs 332 and 334 as well as the hanging portions of the ribs 334 adjacent to those upper ends.

In this way, by forming, in the region on the front side of the lower casing 160, the pair of ribs 332 extending in the lengthwise direction as well as the ribs 334 which connect the ribs 332 together in the widthwise direction and extend to the outer sides of those ribs 332, deformation (bending) in the direction orthogonal to the lengthwise direction of the lower casing 160 and the main instrument unit 100 can be inhibited, and the strength of the casing can be improved. Moreover, by forming the ribs 332 and 334 so as to protrude separated from the keyboard unit 120 in a region of the lower casing 160 directly beneath the keypress positions of the keys, even when the user performs a keypress operation, none of the associated impact or pressing force is directly transmitted to the lower casing 160, which makes it possible to inhibit deformation (bending) of the lower casing 160 and the main instrument unit 100 and also makes it possible to suppress abnormal noises and vibrations when keys are pressed.

Note that FIG. 3B illustrates an example in which the third casing reinforcing section 330 including the ribs 332 and 334 is arranged divided in two in the lengthwise direction of the lower casing 160. Here, the ribs 332 and 334 are arranged divided in this manner to avoid a battery box which is the driving power supply of the main instrument unit 100 and is arranged substantially near the center of the lower casing 160 in the lengthwise direction, but the present invention is not limited to this configuration. By modifying the layout design of the lower casing 160, a single continuous third casing reinforcing section 330 may be arranged, or the third casing reinforcing section 330 may be arranged divided into two or more sections.

Moreover, it is preferable that the ribs 332 and 334 be arranged near attachment bosses or attachment holes for fastening the upper casing 140 and the keyboard unit 120 to be assembled onto the lower casing 160 with fasteners such as screws. In this case, by forming the ribs 332 and 334 integrally with or connected to the attachment bosses and then fastening the upper casing 140 and the keyboard unit 120, or by fastening the upper casing 140 and the keyboard unit 120 via attachment holes, the strength of the casing can be improved even when the ribs 332 and 334 are made of thin plate-shaped members, and the space required for component layout within the main instrument unit 100 can be reduced.

(4) Fourth Casing Reinforcing Section 340

Figure 13A:
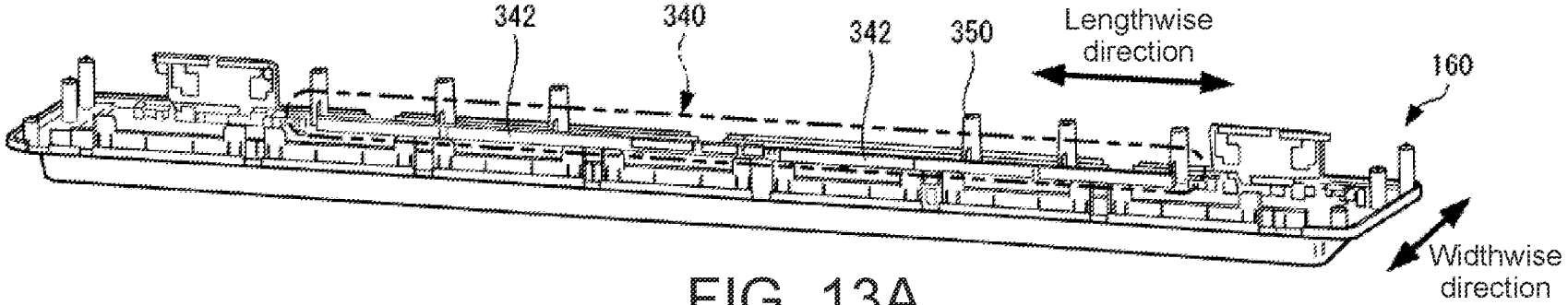
FIGS. 13A to 13C are perspective views schematically illustrating a fourth casing reinforcing section used in the keyboard instrument according to the embodiment.
Figure 13B:
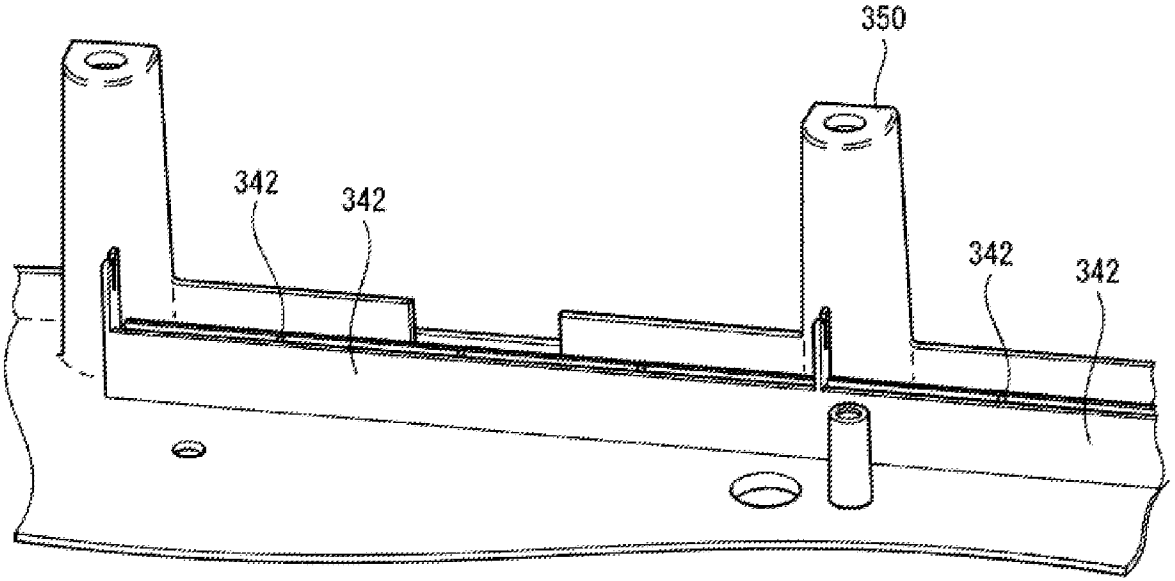
Figure 13C:
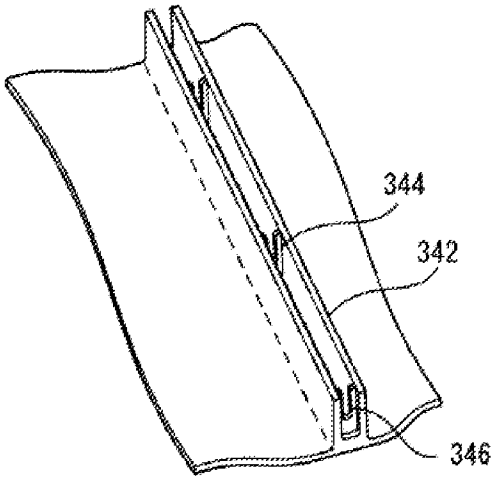
Figure 14:
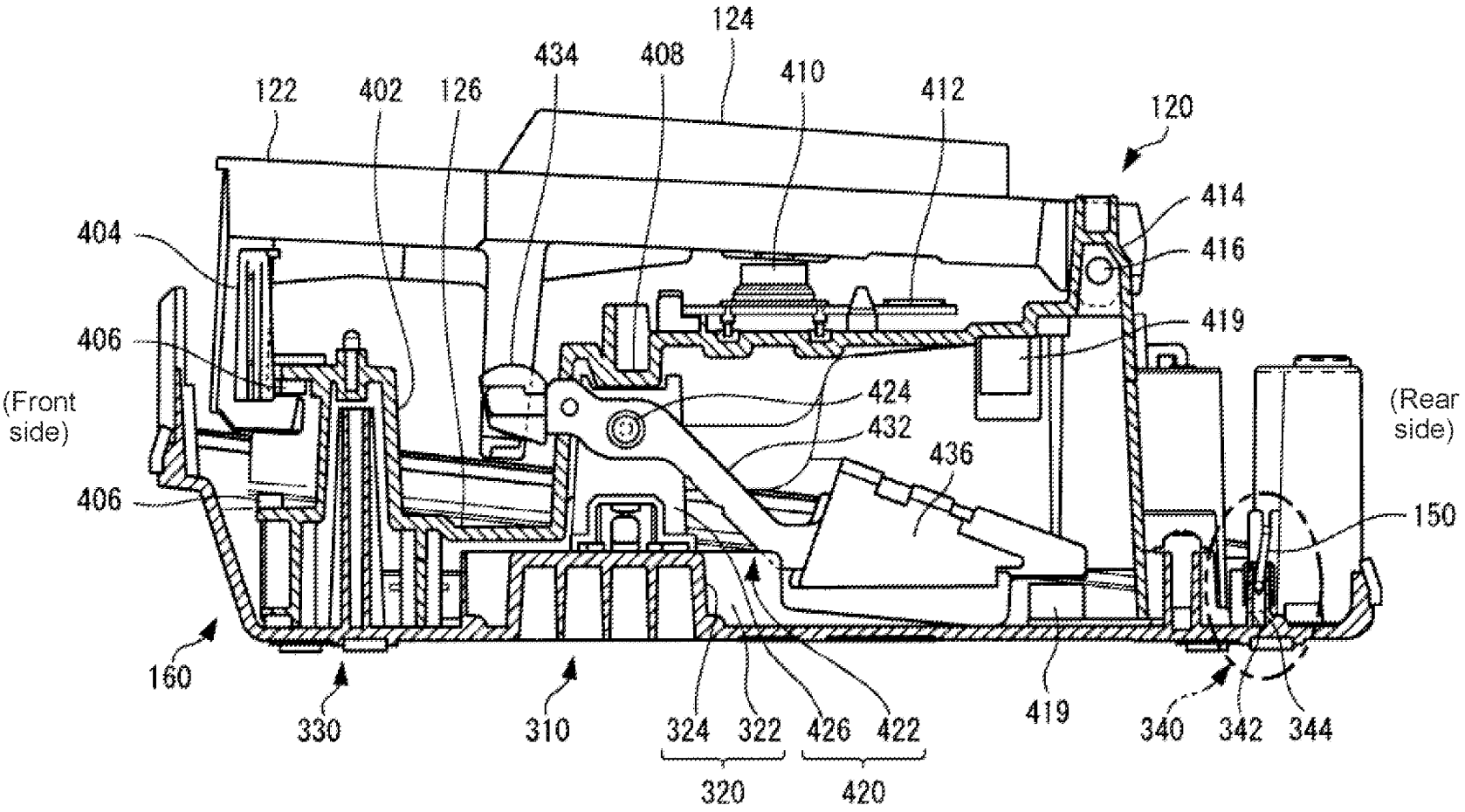
FIG. 14 is a cross-sectional view schematically illustrating the main instrument unit to which the fourth casing reinforcing section according to the embodiment has been applied.
Figure 15A:
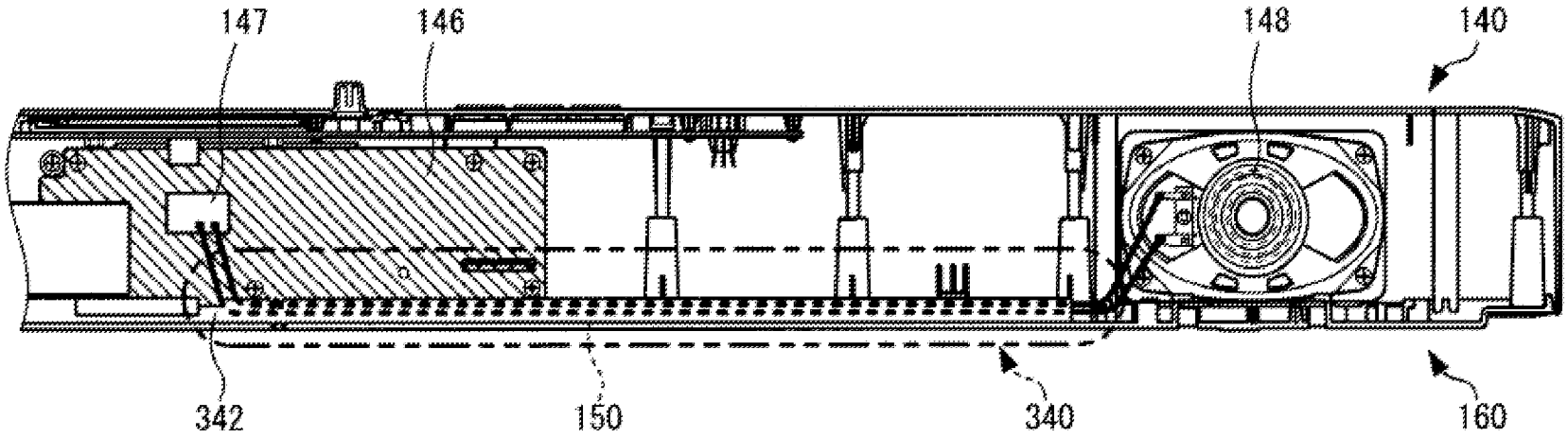
FIGS. 15A and 15B schematically illustrate an example of cable layout within the main instrument unit to which the fourth casing reinforcing section according to the embodiment has been applied.
Figure 15B:
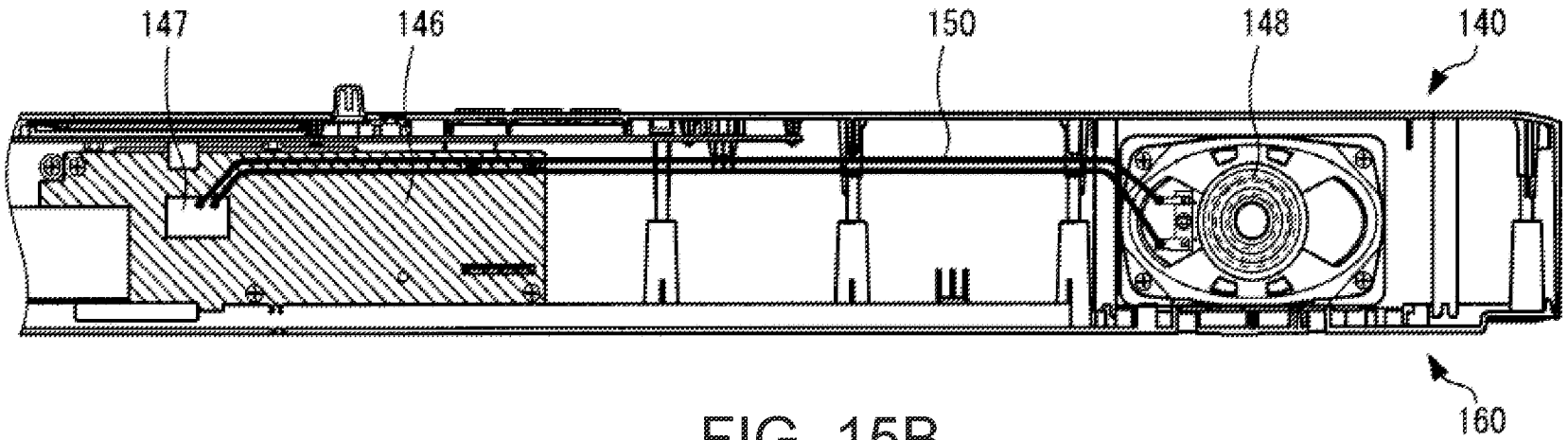

FIGS. 13A-13C are a perspective view schematically illustrating a fourth casing reinforcing section used in the keyboard instrument according to the present embodiment. FIG. 13A is an overall perspective view illustrating the lower casing to which the fourth casing reinforcing section has been applied, and FIGS. 13B and 13C are perspective views illustrating the primary components of the fourth casing reinforcing section. FIG. 14 is a cross-sectional view schematically illustrating the main instrument unit to which the fourth casing reinforcing section according to the present embodiment has been applied. Note that the cross-section illustrated in FIG. 14 omits the upper casing in order to simplify the illustration. FIGS. 15A-15B schematically illustrates an example of cable layout within the main instrument unit to which the fourth casing reinforcing section according to the present embodiment has been applied. FIG. 15A is a view illustrating an example of speaker cable layout in the main instrument unit to which the fourth casing reinforcing section has been applied, and FIG. 15B is a view illustrating an example of speaker cable layout for comparison.

More specifically, as illustrated in FIGS. 3B, 13A, 13B, 13C, and 14, in the fourth casing reinforcing section 340, ribs (reinforcing members) 342 including a pair of plate-shaped members arranged near to and facing one another are arranged on the inner surface side of the lower casing 160 in a region (fourth region) which extends in the lengthwise direction of the lower casing 160 on the rear side of the keyboard unit 120 and is a region on the rear side (upper side in FIG. 3B; far side in FIGS. 13A-13C; FIG. 14) in the widthwise direction of the main instrument unit 100. Moreover, in the fourth casing reinforcing section 340, between the pair of ribs 342, ribs 344 including plate-shaped members that connect together the pair of ribs 342 are arranged extending in the widthwise direction of the lower casing 160 orthogonal to the lengthwise direction. Here, as illustrated in FIGS. 13A-13C, the ribs 344 have substantially the same height as the ribs 342. Furthermore, as illustrated in FIGS. 13A, 13B, 13C, and 14, in the upper ends of the ribs 344, slits 346 including U-shaped or V-shaped grooves are formed for housing and holding in place between the pair of ribs 342 speaker cables 150 which connect between the sound source circuit board (circuit board) 146 and the speakers (sound emitters) 148 that are installed into the upper casing 140 and arranged on the rear side of the keyboard unit 120. In addition, as illustrated in FIG. 15A, the height with which the ribs 342 and 344 protrude from the lower casing 160 is set such that the speaker cables 150 running between the sound source circuit board 146 and the speakers 148 as well as wires or electronic components of the sound source circuit board 146 do not overlap when viewed in a plan view or are not overly close to one another.

In this way, by forming the pair of ribs 342 extending in the lengthwise direction as well as the ribs 344 which connect the ribs 342 together in the widthwise direction in the region on the rear side of the lower casing, deformation (bending) in the direction orthogonal to the lengthwise direction of the lower casing 160 and the main instrument unit 100 can be inhibited, and the strength of the casing can be improved. Moreover, by using the slits 346 formed in the ribs 344 that connect together the pair of ribs 342 to hold in place and house between the pair of ribs 342 the speaker cables 150 running between the sound source circuit board 146 and the speakers 148 housed within the main instrument unit 100, the speaker cables 150 and the sound source circuit board 146 can be prevented from overlapping in a plan view or being close to one another.

Here, if as illustrated in FIG. 15B the speaker cables 150 overlap with the sound source circuit board 146 in a plan view or are arranged overly close thereto, noise from the sound source circuit board 146 is introduced and makes the sound quality of the musical sounds emitted from the speakers 148 more prone to degradation. In contrast, in the present embodiment the height of the ribs 342 and 344 are set so as to prevent (to the greatest extent possible) the speaker cables 150 and the sound source circuit board 146 from overlapping in a plan view or being close to one another, therefore making it possible to reduce introduction of noise into the musical sounds emitted from the speakers 148 and to thereby improve sound quality. Moreover, in this case introduction of noise can be reduced without changing the arrangement of a connector 147 for the speaker cables 150 that is formed in the sound source circuit board 146, thereby making it possible to use an existing circuit board as-is.

Furthermore, as illustrated in FIGS. 13A-13C, the ribs 342 are arranged near attachment bosses 350 for fastening the upper casing 140 and the keyboard unit 120 to be assembled onto the lower casing 160 with fasteners such as screws, and the ribs 342 are formed integrally with the attachment bosses 350 or connected to the attachment bosses 350. In this way, the strength of the casing can be improved even when the ribs 342 and 344 are made of thin plate-shaped members, and the space required for component layout within the main instrument unit 100 can be reduced.

Although in the embodiment above a plurality of casing reinforcing sections of different types according to the present invention were described, the electronic keyboard instrument according to the present invention may include all of these casing reinforcing sections, may include any one of these reinforcing sections alone, or may include any combination of these casing reinforcing sections.

Although several embodiments of the present invention were described above, the present invention is not limited to these embodiments and includes the invention as set forth in the claims as well as configurations of equivalent scope.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. An electronic portable keyboard instrument, comprising:

a plurality of keys arranged in a first direction;

a plurality of hammers each having a force application point, a weight, and a fulcrum between the force application point and the weight;

a lower casing that includes a plurality of supporting members that support the respective fulcrums of the plurality of hammers so that each hammer rocks in vertical directions about the fulcrum when a corresponding key is pressed; and a plurality of reinforcing members arranged in the first direction, each of the reinforcing members having a shape of rib that is erected upward from the lower casing and that is running in a length direction of the keys, which is perpendicular to the first direction, wherein each of the plurality of supporting members sandwiches, from sides in the first direction, the corresponding hammer at the fulcrum so as to restrict movement of the hammer in the first direction, and wherein each of the reinforcing members is disposed in a gap between adjacent hammers, and a portion of the reinforcing members that is adjacent to the weights of the adjacent hammers is lower than any other portions of the reinforcing member so that, if the adjacent hammers move in the first direction about the fulcrums, the weights of the adjacent hammers do not contact the reinforcing member.

2. The electronic portable keyboard instrument according to claim 1, wherein the plurality of reinforcing members are formed integrally with the lower casing so as to reinforce the lower case in a front-rear direction.

3. The electronic portable keyboard instrument according to claim 1, wherein each of the plurality of hammers has a main hammer unit between the weight and the fulcrum, wherein in each of the hammers, the weight has a greater thicknesses in the first direction than the main hammer unit, and has a lower limit for downward movement, and wherein in each of the reinforcing members, in a side view as seen from the first direction, a portion of the reinforcing member that is located below the main hammer unit extends vertically above a level of the lower limit and a second portion of the reinforcing member that is located below the weight of the hammer does not extend above the lower limit.

4. The electronic portable keyboard instrument according to claim 1, wherein each of the reinforcing members has a notch that is notched out so as not to be contacted by the weights of the hammers adjacent to the reinforcing member when the hammers adjacent to the reinforcing member rock about the respective fulcrums with a lateral positional shift in the first direction.

5. The electronic portable keyboard instrument according to claim 1, wherein each of the plurality of supporting members sandwiches the corresponding hammer such that if the keyboard instrument is placed vertically with one lateral end thereof being at a bottom and another lateral end thereof being at a top, the weight of the hammer leaning downward, shifting in position laterally in the first direction, due to gravity does not contact any of the reinforcing members.

* * * * *